US007234454B2

(12) United States Patent
Tauchi et al.

(10) Patent No.: US 7,234,454 B2
(45) Date of Patent: Jun. 26, 2007

(54) IGNITION COIL AND METHOD FOR MANUFACTURING AN IGNITION COIL

(75) Inventors: Takashi Tauchi, Nagoya (JP); Koji Tsunenaga, Chiryu (JP); Kazuhide Kawai, Kariya (JP); Katsutoshi Shibata, Mie-gun (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/481,047

(22) Filed: Jul. 6, 2006

(65) Prior Publication Data

US 2007/0012301 A1 Jan. 18, 2007

(30) Foreign Application Priority Data

Jul. 12, 2005 (JP) ..... 2005-203385

(51) Int. Cl.
*F02P 3/02* (2006.01)
*H01F 38/12* (2006.01)

(52) U.S. Cl. ..... 123/634; 123/635; 123/647; 439/125; 336/90; 336/107

(58) Field of Classification Search ..... 123/634, 123/635, 647; 439/125; 336/90, 92, 96, 336/107

See application file for complete search history.

(56) References Cited

U.S. PATENT DOCUMENTS

| | | | | |
|---|---|---|---|---|
| 5,433,628 | A | 7/1995 | Sadaishi et al. | |
| 5,618,193 | A * | 4/1997 | Nakajima et al. | 439/125 |
| 5,758,624 | A * | 6/1998 | Satou et al. | 123/634 |
| 6,023,215 | A * | 2/2000 | Sakamaki et al. | 336/96 |
| 6,094,121 | A * | 7/2000 | Sakamaki et al. | 336/96 |
| 6,169,471 | B1 * | 1/2001 | Sakamaki et al. | 336/96 |
| 6,222,435 | B1 | 4/2001 | Bonnefoit | |
| 6,308,696 | B1 * | 10/2001 | Kondo et al. | 123/634 |
| 6,406,307 | B2 * | 6/2002 | Bungo et al. | 439/130 |
| 6,484,708 | B2 * | 11/2002 | Hirakawa et al. | 123/647 |
| 6,639,498 | B2 * | 10/2003 | Shimada et al. | 336/96 |
| 6,977,572 | B2 * | 12/2005 | Kawai et al. | 336/90 |
| 2004/0231652 | A1 * | 11/2004 | Kondo et al. | 123/634 |

FOREIGN PATENT DOCUMENTS

| | | |
|---|---|---|
| JP | A-05-175058 | 7/1993 |
| JP | U-05-91997 | 12/1993 |
| JP | A-H06-084565 | 3/1994 |
| JP | A-06-203904 | 7/1994 |
| JP | A-09-17662 | 1/1997 |
| JP | A-2006-134972 | 5/2006 |
| JP | A-2006-173384 | 6/2006 |

* cited by examiner

*Primary Examiner*—Hai Huynh
(74) *Attorney, Agent, or Firm*—Nixon & Vanderhye PC

(57) ABSTRACT

An ignition coil is disclosed. The ignition coil includes an insulative material, a body, and a head coupled to the body. A portion of the insulative material is included in the body, and a portion of the insulative material is included in the head. The head includes a casing, a flange for coupling to an engine case, and a connector adapted to be connected to an external device. The head also includes a conducting terminal with a connector pin, an exposed contact, and a connecting part. The connector pin is coupled to the connector, the exposed contact is coupled to the casing or the flange, and the connecting part couples the exposed contact and the connector pin. A portion of the connecting part is embedded in the insulative material, and wherein a remaining portion is embedded in the casing. A method of manufacturing the ignition coil is also disclosed.

12 Claims, 17 Drawing Sheets

IGNITION COIL AND METHOD FOR MANUFACTURING AN IGNITION COIL

CROSS REFERENCE TO RELATED APPLICATION

The following claims the benefit of priority from Japanese Patent Application No. 2005-203385, filed Jul. 12, 2006, which is hereby incorporated by reference.

FIELD

The present invention relates to an ignition coil that can be used to generate sparks from the spark plug in an internal combustion engine. The invention also relates to a process for manufacturing the ignition coil.

BACKGROUND

Various ignition coils have been proposed for generating sparks from the spark plug of an internal combustion engine. For example, FIGS. 20 and 21 show a conventional stick type ignition coil 9 for an engine of a car or other vehicle. The ignition coil 9 has a cylindrical body 92 and an igniter head 93. The cylindrical body 92 is inserted in the plug hole of the engine case 8 and fitted with a primary coil and a secondary coil that are coaxial with each other. The igniter head 93 is coupled to one end of the cylindrical body 92 and supplies the primary coil with power.

The igniter head 93 has a connector 933, which is connected electrically to an engine control unit (i.e., ECU) outside the ignition coil 9. The connector 933 includes a connector pin 952 for the battery (i.e., plus power supply), a connector pin 951 for grounding (i.e., minus power supply), and two connector pins 953 for transmission of a control signal. The igniter head 93 also has a casing 931 and a flange 932, which protrudes from the casing 931. The ignition coil 9 is coupled to the engine case 8 by means of the flange 932.

The connector pin 951 for grounding is connected electrically to the engine case 8 so that electrical noise can be reduced. Once electrically connected, the ground in the ignition coil 9 should be at the same potential as the ground in the engine case 8.

Therefore, as shown in FIGS. 20 and 21, the ignition coil 9 has a ground terminal 94, which includes the connector pin 951 for grounding, an annular contact 97 and a connecting part 96. The annular contact 97 is included on one face of the flange 932 so as to abut the engine case 8. The connecting part 96 connects the connector pin 951 and the annular contact 97. The connector pin 951 for grounding is electrically connected (i.e., short-circuited) to the fitting part 82 of the engine case 8 via the connecting part 96 and the annular contact 97.

Typically, the ground terminal 94 is insert-molded in the casing resin material 930 that forms the casing 631. The casing resin material 930 is typically a thermoplastic resin because it is highly moldable. However, because of this material, the resin 930 can release from the ground terminal 94. Consequently, for example, gaps may exist between the casing resin 930 and the ground terminal 94. The gaps may develop over time, for instance, due to temperature changes that occur during the operational life of the ignition coil 9.

As shown in FIG. 20, if moisture S reaches the flange 932, the moisture S may pass through the gaps between the casing resin 930 and the ground terminal 94 and travel from the annular contact 97, along the connecting part 96, and to the connecting pin 951 for grounding. In this case, the water S may cause a short circuit (i.e., an insulation failure) between the connecting pin 951 and one of the other connector pins 952, 953 and/or corrode (i.e., rust) the connecting pin 951. Also, a contact failure (i.e., a conduction failure) may occur between the corroded pin 951 and the socket to which the connector pins 951-953 are connected.

U.S. Pat. No. 5,433,628 (Japanese Patent No. 6-84565A) discloses a sealing structure in which a connector is molded integrally with a connector housing. Part of a terminal of the connector is embedded in the wall of the connector housing through a seal coating material. As such, water and/or oil is unlikely to intrude from the connector terminal into the connector housing.

However, the device of U.S. Pat. No. 5,433,628 uses a seal coating material to limit the intrusion of water and/or oil. Thus, the construction of the device is relatively complex.

SUMMARY OF THE INVENTION

An ignition coil adapted to be coupled to an engine case and an external device is disclosed. The ignition coil includes an insulative material, a body, and a head coupled to the body. A portion of the insulative material is included in the body, and a portion of the insulative material is included in the head. The head includes a casing, a flange adapted to be coupled to the engine case, and a connector adapted to be connected electrically to the external device. The head also includes a conducting terminal with a connector pin, an exposed contact, and a connecting part. The connector pin is coupled to the connector, the exposed contact is coupled to at least one of casing and the flange, and the connecting part couples the exposed contact and the connector pin. A portion of the connecting part is embedded in the insulative material, and wherein a remaining portion is embedded in the casing.

A method for manufacturing an ignition coil is also disclosed. The ignition coil includes a body and a head adapted to be fixed to an engine case. The head includes a casing, a flange, a connector, and a conducting terminal. The flange is adapted to be fixed to the engine case, and the connector is adapted to be electrically connected to an external device. The conducting terminal includes a connector pin, an exposed contact, and a connecting part. The connector pin is coupled to the connector, the exposed contact is coupled to at least one of the casing and the flange, and the connecting part couples the exposed contact and the connector pin. The method includes forming the head by insert-molding the conducting terminal in the casing, such that a portion of the connecting part is embedded in the casing, and such that a conducting protrusion of the connecting part protrudes from the casing. The method also includes introducing an insulative material into the casing such that the conducting protrusion is embedded within the insulative material.

DETAILED DESCRIPTION OF THE PREFERRED EMBODIMENTS

With reference to the drawings, descriptions will be provided of embodiments of an ignition coil according to the present invention and a process for manufacturing the coil.

First Embodiment

Figure 1:
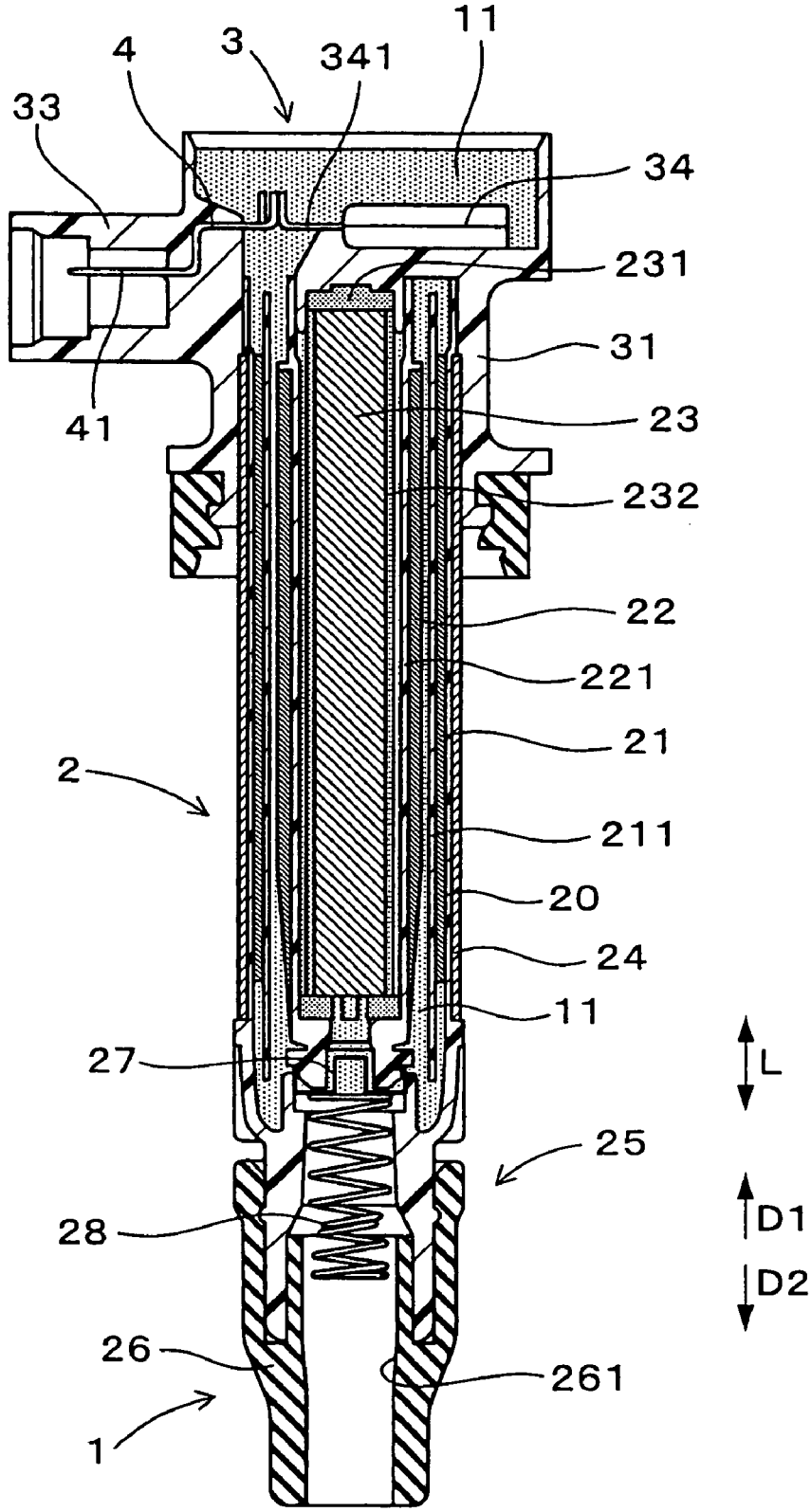
FIG. 1 is a sectional view of an ignition coil according to one embodiment of the present invention.
Figure 2:
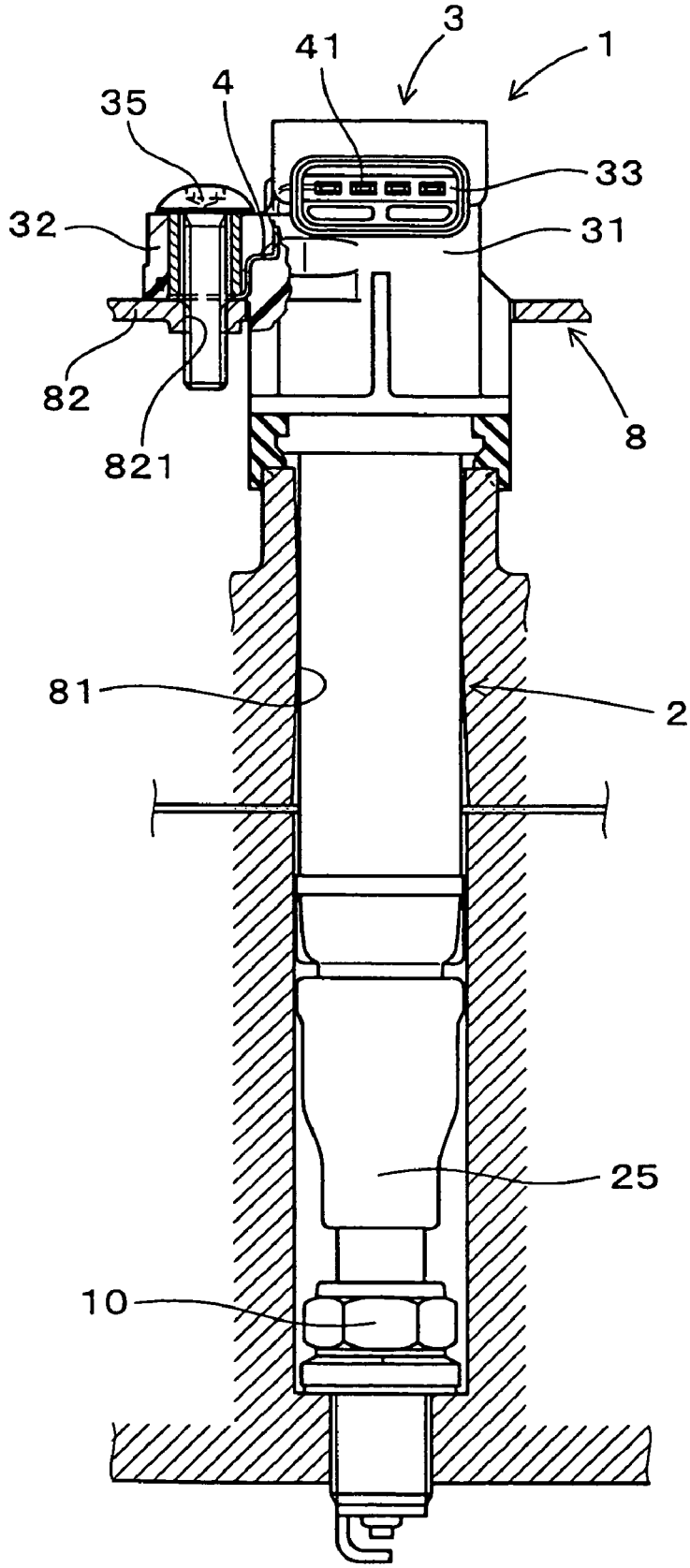
FIG. 2 is a sectional view of the ignition coil of FIG. 1 shown inserted in the engine case.

As shown in FIGS. 1 and 2, one embodiment of an ignition coil 1 according to the present invention is shown. The ignition coil 1 has a cylindrical body 2 and a head 3. The cylindrical body 2 includes a primary coil 21 and a secondary coil 22 that are coaxial with each other. The cylindrical body 2 is inserted in the plug hole 81 of the engine case 8. The head 3 extends from the cylindrical body 2 and is fixed to the engine case 8 of an engine.

The ignition coil 1 also includes an insulating material, such as an insulative resin 11. The insulative resin 11 is contained within the space between the head 3 and the cylindrical body 2. In one embodiment, the space between the head 3 and the cylindrical body 2 is filled with the insulative resin 11.

Figure 3:
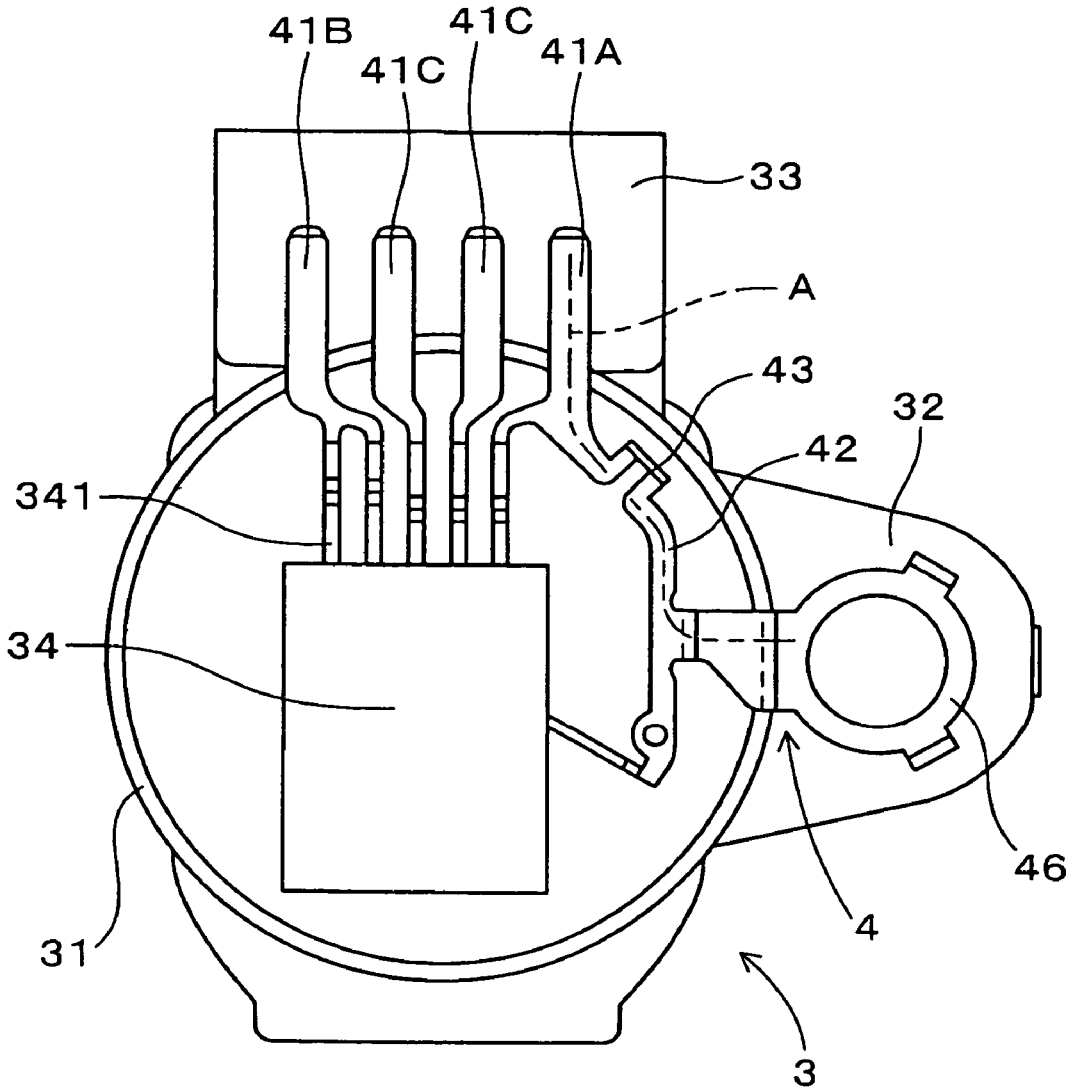
FIG. 3 is a plan view of the ignition coil of FIG. 1.
Figure 4:
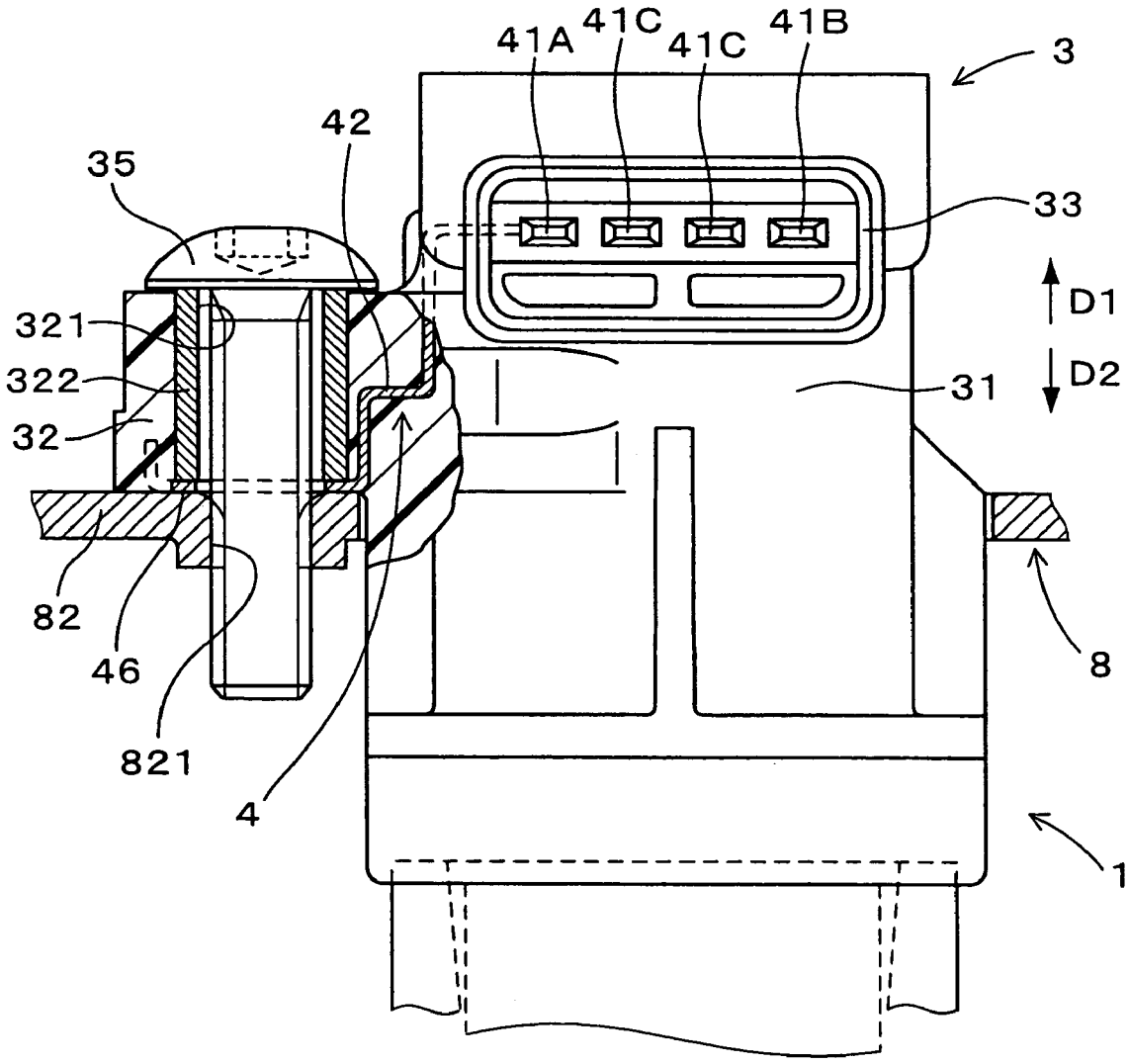
FIG. 4 is an enlarged side view of a head of the ignition coil of FIG. 1.
Figure 5:
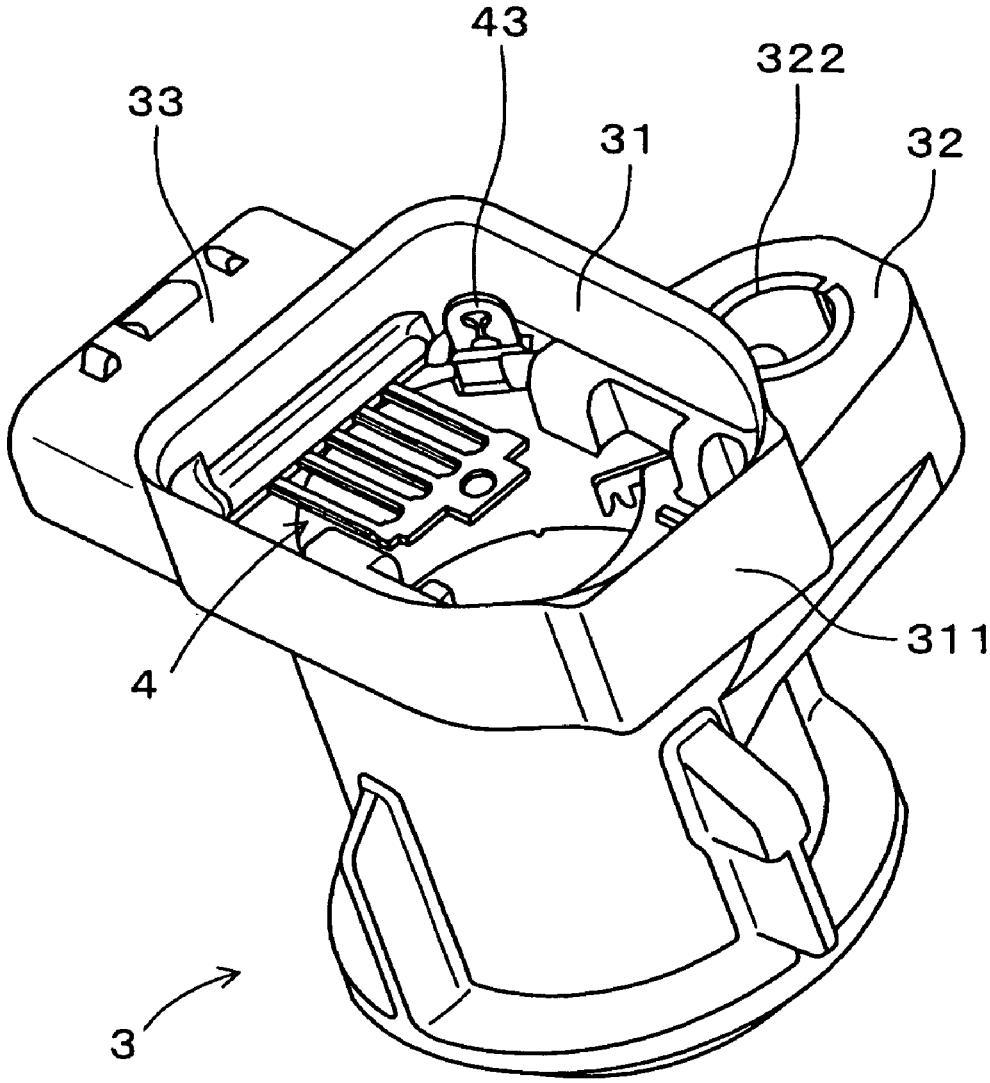
FIG. 5 is a perspective view of the head of the ignition coil of FIG. 1.

As shown in FIGS. 3-5, the head 3 includes a substantially cylindrical casing 31, a flange 32, a connector 33, and a conducting terminal 4. The conducting terminal 4 is operable as an electrically conducting path A, which will be described in greater detail below. The flange 32 and connector 33 protrude radially from the casing 31. The flange 32 is coupled to the engine case 8. The connector 33 is connected electrically to an external device (e.g., the ECU).

The conducting terminal 4 includes a connector pin 41 (FIG. 1), an exposed contact 46, and a connecting part 42. The connector pin 41 is included (i.e., embedded) in the connector 33. The exposed contact 46 is included on the flange 32. In another embodiment, the exposed contact 46 is coupled to the casing 31. The connecting part 42 electrically connects the exposed contact 46 and the connector pin 41. In one embodiment, the conducting terminal 4 is insert-molded in a casing resin 311 material to thereby form and attach the conducting terminal 4 and the casing 31.

Figure 6:
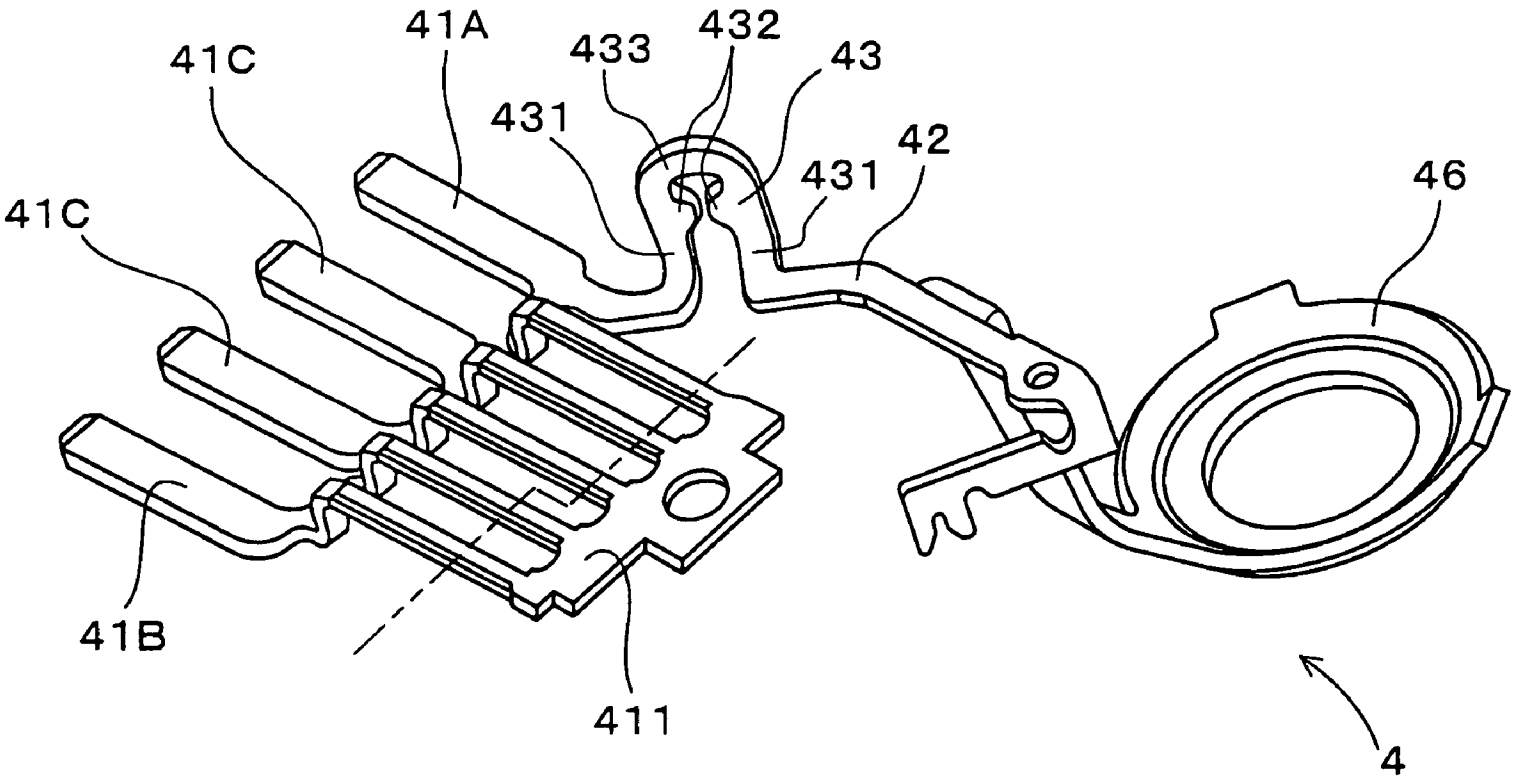
FIG. 6 is a perspective view of the conducting terminal of the ignition coil of FIG. 1.

As shown in FIGS. 5 and 6, the connecting part 42 has a conducting protrusion 43 as a portion of the conducting path A. The conducting protrusion 43 protrudes from the casing resin 311 material of the casing 31. The conducting protrusion 43 is embedded in the insulative resin 11 inside the head 3, and the remainder of the connecting part 42 is embedded in the casing resin 311.

With reference to FIGS. 1-13, the ignition coil 1 will be described below in detail.

As shown in FIG. 1, the primary coil 21 is an insulatively coated primary wire wound several times around a primary spool 211, and the secondary coil 22 is an insulatively coated secondary wire wound around a secondary spool 221 more times than the primary wire. The spools 211 and 221 are formed of cylindrical resin. The primary coil 21 surrounds the secondary coil 22, and the secondary coil 22 surrounds a center core 23 formed of an electromagnetic steel plate. The primary coil 21 is surrounded by a coil case 20 formed of cylindrical resin, which is surrounded by an outer cylindrical core 24 formed of an electromagnetic steel plate.

The center core 23 consists of flat silicon steel plates, which are coated insulatively and laminated perpendicularly to the axis (i.e., along the direction L) of the ignition coil 1. The laminated plates are joined together by welding their ends. The outer cylindrical core 24 consists of silicon steel cylinders, which have axial slits and are laminated radially with an adhesive. The magnetic flux produced by a current flowing through the primary coil 21 can be increased by passing through the two cores 23, 24. The center core 23 is fitted with buffers 231 each on one of its ends and wound with an insulating sheet 232 for stress relaxation.

It will be appreciated that the primary coil 21 could be formed without the primary spool 211. In this case, the process for forming the primary coil 21 might include the steps of winding insulatively coated primary wires around a cylindrical jig, bonding the wound wires with a fusing agent or the like, and removing the bonded wires from the jig. The removed wires form a cylindrical primary coil 21.

As shown in FIG. 1, the space between the center core 23 and secondary coil 22, the space between the two coils 22 and 21, and the space between the primary coil 21 and coil case 20 are filled with the insulative resin 11.

As shown in FIGS. 1 and 2, the head 3 is included on one end of the cylindrical body 2. In FIG. 1, the head 3 is included in at the terminal end of the body 2 in the D1 direction. A plug fitting 25 is formed on the opposite end of the body 2 (i.e., at the terminal end of the body 2 in the D2 direction). A spark plug 10 can be fitted to the plug fitting 25.

The head 3 has an igniter 34 that supplies the primary coil 21 with power. The igniter 34 is included in the casing 31 of the head 3. The igniter 34 has pins 341 formed on it, each for connection with one of the connector pins 41A-41C.

As shown in FIG. 1, the igniter 34 is included in the casing 31, and the casing 31 of the head 3 is filled with the insulative resin 11. The insulative resin 11 continuously fills spaces in the cylindrical body 2 and the space in the casing 31.

The igniter 34 has a power control circuit, an ion current sensing circuit, etc. The power control circuit includes switching elements that operate with signals from an ECU (engine control unit).

When a pulsed sparking signal is transmitted from the ECU to the igniter 34, the switching elements etc. in the igniter 34 operate, so that a current flows through the primary coil 21, forming a magnetic field in one direction through the two cores 23, 24. This results in an induction field being formed in the opposite direction through the two cores 23, 24. The formation of the induction field induces a counter electromotive force in the secondary coil 22, causing the spark plug 10 fitted on the ignition coil 1 to spark.

As shown in FIGS. 1 and 2, the plug fitting 25 includes an extension 201 from the coil case 20 and a plug cap 26 made of rubber, which is fitted on the extension 201. The plug cap 26 has a plug hole 261 formed through it for engagement with the spark plug 10. A lower portion of a coil spring 28 is positioned in the plug hole 261 and can contact the spark plug 10. The coil spring 28 is connected electrically via a high-voltage terminal 27 to the high-voltage end of the secondary coil 22.

As shown in FIGS. 3 and 6, the conducting terminal 4 is a ground terminal connected to the engine case 8. The connector pin 41 of the conducting terminal 4 is a connector pin 41A for ground potential.

As shown in FIG. 4, when the ignition coil 1 is coupled to the engine case 8 by means of the flange 32, the ground terminal 4 is connected to (i.e., short-circuits) the engine case 8 so that there can be no difference between the ground potential at the ignition coil 1 and the ground potential at the case 8.

As shown in FIGS. 4 and 6, the exposed contact 46 of the conducting terminal 4 is annular and positioned on the bottom surface (i.e., the surface in the D2 direction) of the flange 32 so as to abut the engine case 8. The flange 32 of the head 3 has a bolt hole 321 formed through it. A clamping bolt 35 extends through the bolt hole 321 and engages with the engine case.8 for retaining the flange.

As shown in FIG. 4, a conductive reinforcing ring 322 is positioned in the flange 32 and is coaxial with the bolt hole 321. In one embodiment, the conductive reinforcing ring 322 is insert-molded in the flange 32. The exposed contact 46 is positioned in the flange 32 and abuts the reinforcing ring 322. In another embodiment, the exposed contact 46 is positioned on the top surface of the flange 32 (i.e., the surface in the D1 direction), and the exposed contact 46 is in electrical connection with the engine case 8 through the clamping bolt 35.

In one embodiment, the casing resin 311 is used in a molding process to form and integrally connect the casing 31, the flange 32, and the connector 33.

As shown in FIG. 4, the flange 32 of the head 3 is supported by a mounting part 82 of the engine case 8. The mounting part 82 has a tapped hole 821 formed therein. The clamping bolt 35 extends through the bolt hole 321 and engages with the tapped hole 821 so that the ignition coil 1 can be fixed to the engine case 8.

The connector 33 of the head 3 is substantially perpendicular to the flange 32 around the axis (i.e., around the axial direction L) of the cylindrical body 2.

As shown in FIGS. 3 and 4, the connector pin 41A for ground potential (i.e., negative power supply), the connector pin 41B for the battery (i.e., positive power supply), and two connector pins 41C for the control signal are arrayed in the connector 33. The connector pin 41A for ground potential is the outermost one of the arrayed pins 41A-41C. The connector pins 41A-41C protrude from the connector 33 to be connected to the pin jacks (not shown) of a connector (socket), which can be connected to the ECU or another electronic device.

In one embodiment, the conducting terminal 4 is press-molded out of a thin conductive metallic plate. In an initial condition (i.e., immediately after press-molding) the connector pins 41B, 41C extend parallel to and are connected to the connector pin 41A via an auxiliary part 411.

Then, as shown in FIG. 3, the conducting terminal 4 is insert-molding in the casing resin 311 (i.e., casing 31). Next, the connector pins 41A-41C are separated by cutting away the auxiliary part 411 (e.g., along the broken line of FIG. 6). As such, each of the separated pins 41A-41C is connected with a corresponding pin 341 of the igniter 34.

Figure 7:
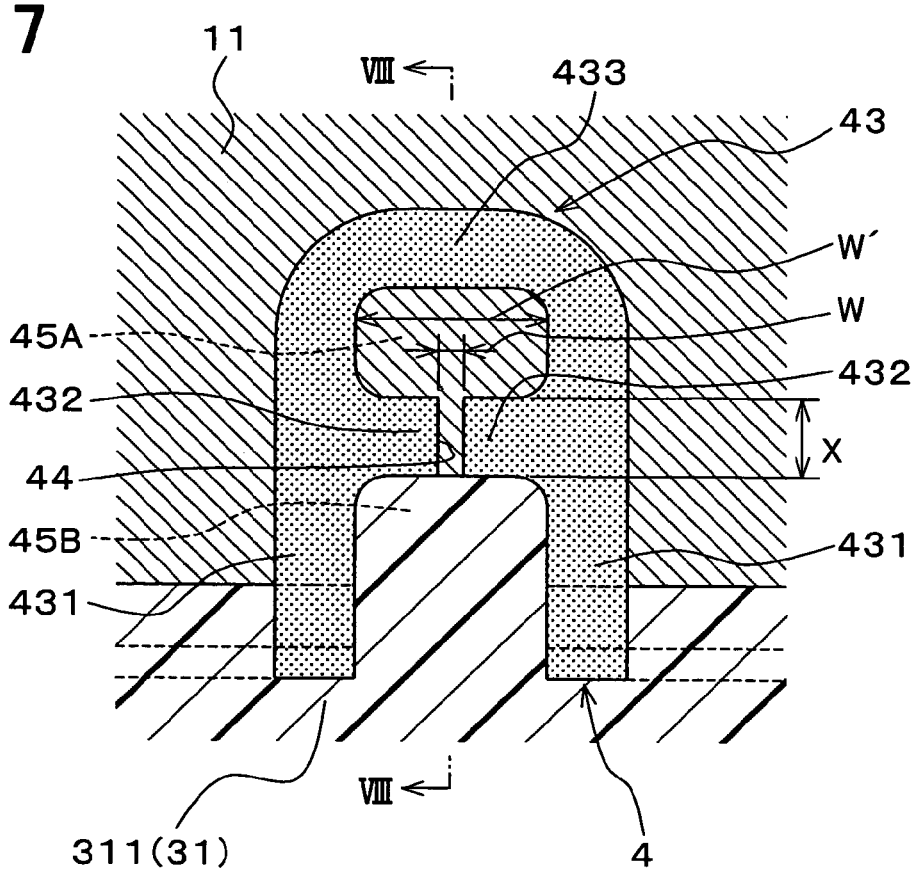
FIG. 7 is a sectional view of the conducting protrusion of the ignition coil of FIG. 1.

The conducting protrusion 43 protrudes from surrounding areas of the connecting part 42 in the axial direction D1. As shown in FIGS. 6 and 7, the conducting protrusion 43 of the connecting part 42 includes a pair of extending parts 431 and a pair of slit-forming protrusions 432. In the embodiment shown, the slit-forming protrusions 432 are positioned at approximately the middle of the extending parts 431. As shown in FIG. 7, the extending parts 431 protrude from the casing resin 311 (i.e., the casing 31) of the head 3. The extending parts 431 are electrically connected to each other at a link 433 that is disposed in spaced relationship to the casing resin 311 (i.e., the casing 31) such that the link 433 is located and embedded in the insulative resin 11. Each slit-forming protrusion 432 protrudes inward from one of the extending parts 431 toward the other extending part 431. As such, a slit 44 is defined between the slit-forming protrusions 432. As shown in FIG. 7, the width W of the slit 44 is smaller than the width W' of the space between the extending parts 431 (i.e., the slit 44 is narrower).

In one embodiment, the width W of the slit 44 is between 0.2-0.6 mm and the length X of the slit 44 is one millimeter or more. In one embodiment, the length X of the slit 44 is two millimeter or less. Furthermore, in one embodiment, the thickness T of the slit 44 is between 0.5-1 mm.

As shown in FIG. 7, a space 45A for insulative resin is defined between the extending parts 431, the upper side of the slit-forming protrusions 432, and the link 433. Insulative resin 11 is included in (e.g., fills) the space 45A. A space 45B for casing resin is also defined on the under sides of the slit-forming protrusions 432 between the extending parts 431. Casing resin 311 is included in (e.g., fills) the space 45B.

Figure 9:
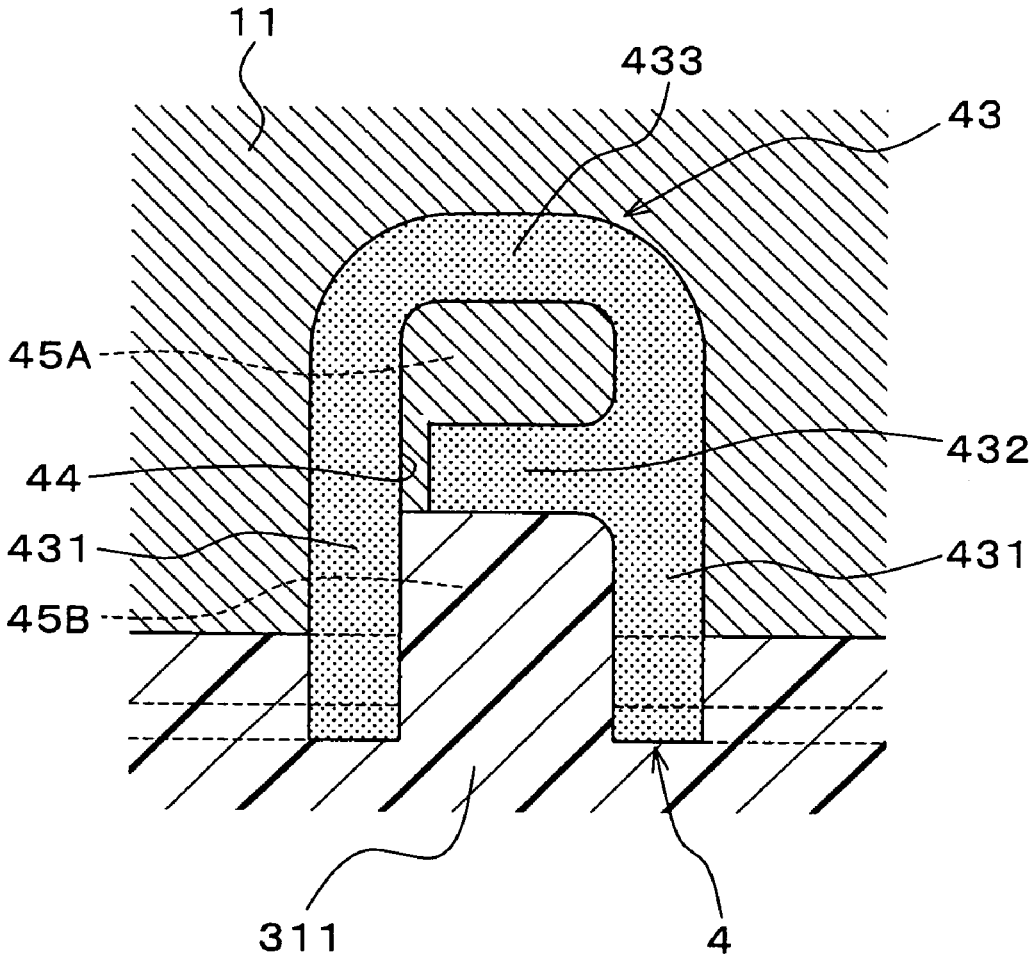
FIG. 9 is a sectional view of another embodiment of the conducting protrusion.

FIG. 9 shows a modified conducting protrusion 43, which has a pair of extending parts 431 and a slit-forming protrusion 432. The slit-forming protrusion 432 extends from one of the extending parts 431 toward the other extending part 431. As such, a slit 44 is defined between the slit-forming protrusion 432 and one of the extending parts 431. The width of the slit 44 is smaller than the width between the extending parts 431.

It will be appreciated that the slit-forming protrusion 432 could protrude from the bottom of one of the extending parts 431. In this case, the space 45A for insulative resin would be defined between the upper side of the slit-forming protrusion 432, the extending parts 431, and the link 433. No space 45B for casing resin would be included.

It will also be appreciated that the space between the extending parts 431 could be narrow so that the slit 44 is formed between the extending parts 431 instead of including the slit-forming protrusion(s) 432. In this case no space 45A for insulative resin would be formed.

In one embodiment, the insulative resin 11 is a resinous material that has a lower coefficient of linear expansion than the casing resin 311. Furthermore, in one embodiment, the insulative resin 11 readily adheres to the conducting terminal 4. In one embodiment, the insulative resin 11 adheres more readily to the conducting terminal 4 than the casing resin 311. For instance, in one embodiment, the insulative resin 11 is an epoxy resin, phenolic resin, or another thermosetting resin. Furthermore, in one embodiment, the casing resin 311 is SPS (syndiotactic polystyrene), PPE (modified polyphenylene ether), PBT (polybutylene terephthalate), PET (polyethylene terephthalate), PPS (polyphenylene sulfide), or another thermoplastic resin.

Thus, the insulative resin 11 is fixedly coupled (i.e., adhered or bonded) to the conducting protrusion 43 of the conducting terminal 4. In contrast, the casing resin 311 may be spaced from conducting terminal 4.

Figure 10:
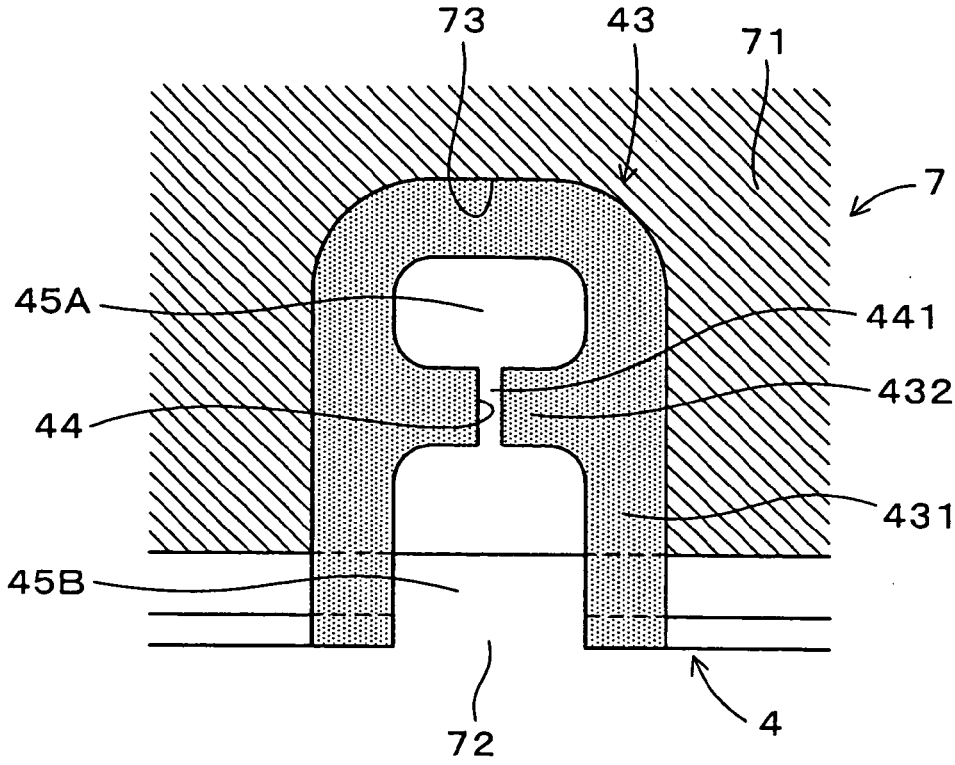
FIG. 10 is a sectional view of the conducting protrusion, showing the terminal in a mold.
Figure 11:
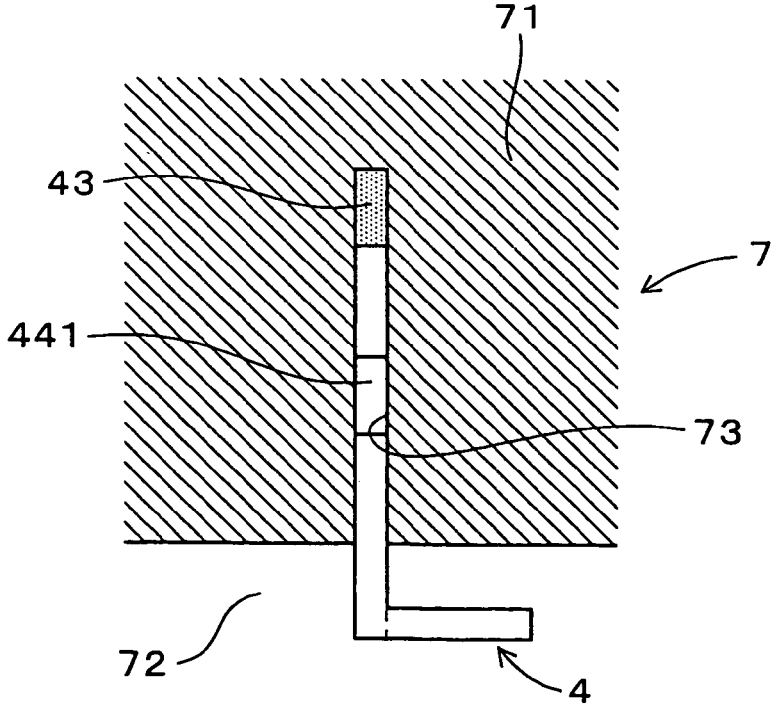
FIG. 11 is a sectional view of the conducting protrusion, showing the terminal in a mold.
Figure 12:
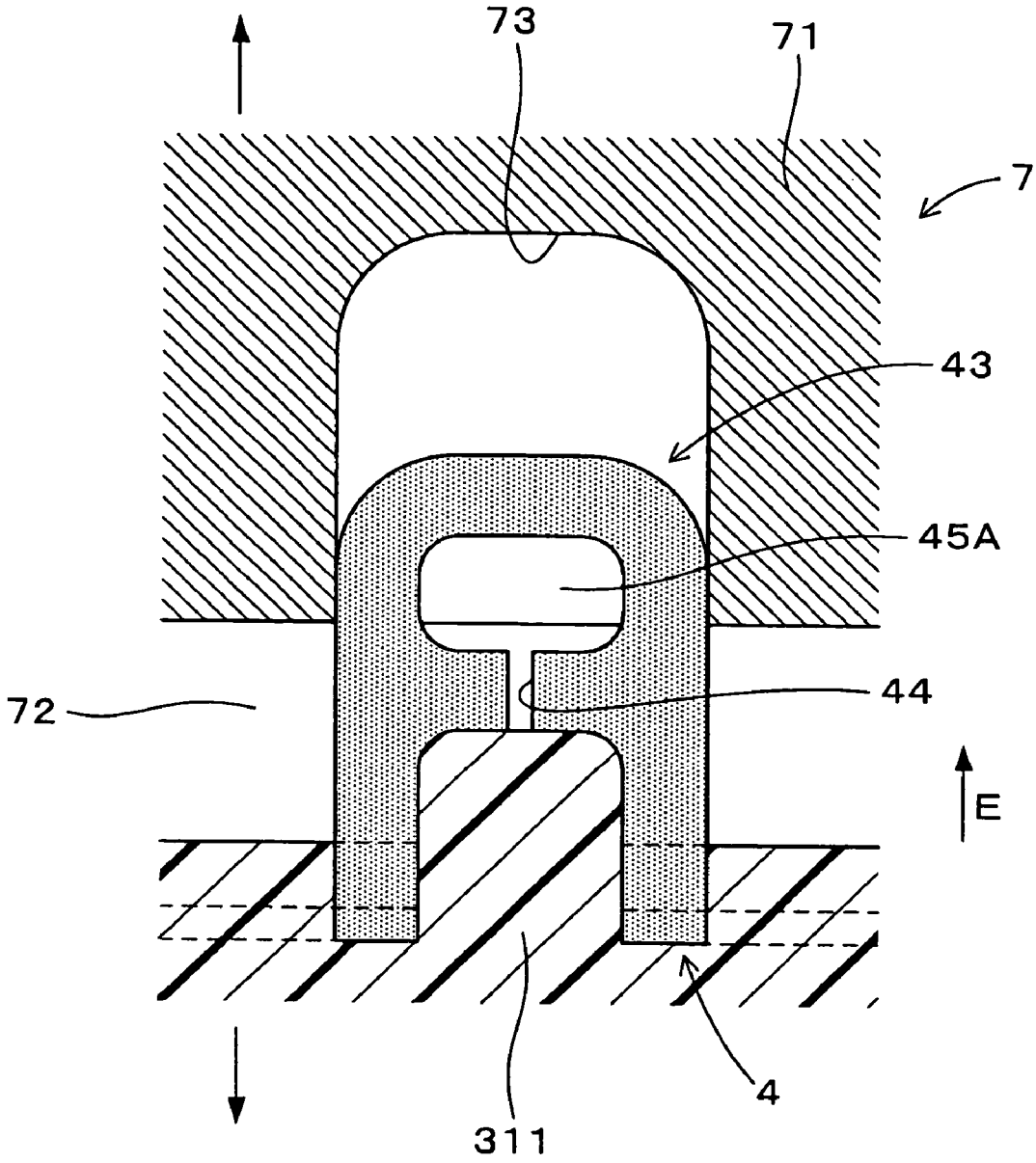
FIG. 12 is a sectional view of the conducting protrusion of the conducting terminal, showing the terminal released from a mold.
Figure 13:
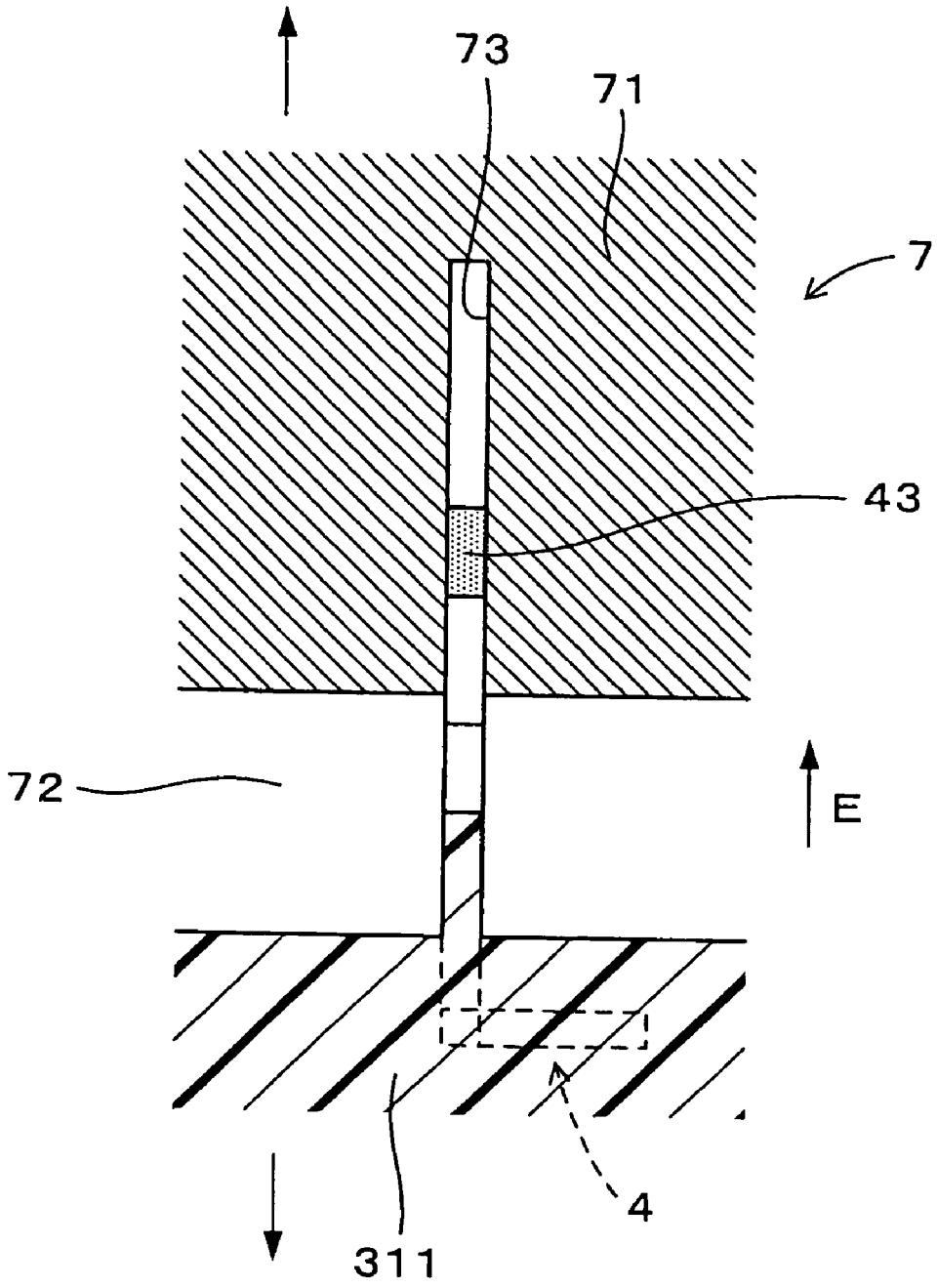
FIG. 13 is a sectional view of the conducting protrusion, showing the terminal released from a mold.

As shown in FIGS. 10 and 11, the conducting terminal 4 is insert-molded in the casing resin 311 by means of a mold 7. As shown in FIGS. 10 and 11, the mold 7 has a pair of dies 71 and a cavity 72 formed between them, in which the casing 31, the flange 32, and the connector 33 can be molded. One of the dies 71 has a recess 73, in which the conducting protrusion 43 can be positioned. As shown in FIGS. 12 and 13, the dies 71 can move relative to each other in the direction E (i.e., in the same general direction that the conducting protrusion 43 extends. It is noted that the recess 73 does not have an undercut, which would otherwise hinder the conducting protrusion 43 from being released from the die 71.

As shown in FIGS. 10 and 11, the process for manufacturing the ignition coil 1 also includes positioning the terminal 4 in the cavity 72 of the mold 7. As such, the conducting protrusion abuts the internal surfaces of the recess 73 in the associated die 71, and the slit 44 is open to the cavity 72.

The casing resin 311 is supplied to the cavity 72 to thereby form the casing 31. However, with reference to FIGS. 7 and 8, the width W, length X and thickness T of the slit 44 (i.e., the sectional area and length of the slit passage 441) are such that the casing resin 311 supplied into the cavity 72 cannot readily flow through the slit 44 into the space 45A.

In this way, as shown in FIG. 5, the head 3 including the casing 31 is formed with the conducting terminal 4 insert-molded in the casing resin 311 (casing 31). As shown, the conducting protrusion 43 remains protruding from the casing resin 311 while the remainder of the conducting path A in the connecting part 42 is embedded in the casing resin 311. Furthermore, the flange 32 and the connector 33 are formed integrally with the casing 31.

Figure 8:
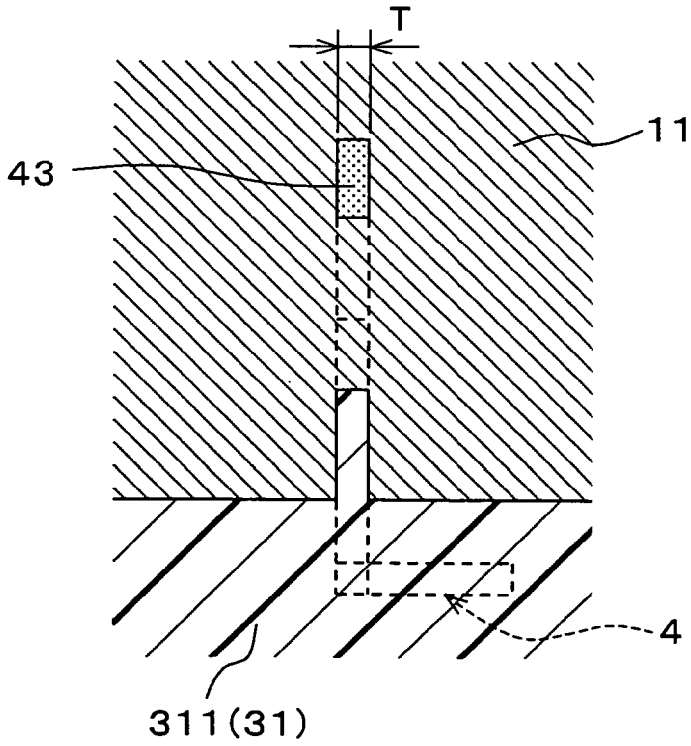
FIG. 8 is a sectional view taken along line VIII-VIII of FIG. 7.

Subsequently, the inside of the casing 31 is filled with insulative resin 11. More specifically, as shown in FIGS. 7 and 8, the insulative resin 11 also flows into the space 45A and the slit 44 in the conducting protrusion 43. As a result, the overall periphery of the conducting protrusion 43 is embedded in and in contact with the insulative resin 11.

Thus, it is possible to form the casing 31 without an undercut in the mold 7. Furthermore, as shown in FIGS. 12 and 13, the molded casing 31 can be easily removed from the cavity 72 of the mold 7 by sliding the dies 71 relative to each other in the direction E. This makes the mold 7 simple in structure and the molded casing 31 easy to remove from the cavity 72.

In the head 3, which is fitted with the conducting terminal 4, moisture that contacts the flange 32 is unlikely to intrude into the head 3 through the gaps between the terminal 4 and the flange 32 or between the terminal 4 and the casing 31. Thus, a short circuit (i.e., an insulation failure) and/or a contact failure (i.e., conduction failure) at the connector pin 41A are unlikely to occur.

More specifically, the majority of the conducting path A of the connecting part 42 is embedded in the casing resin 311. Furthermore, the conducting protrusion 43 of the conducting path A is embedded not in the casing resin 311, but in the insulative resin 11. In other words, the overall periphery of the buried protrusion 43 is in contact with the insulative resin 11. This reduces the formation of gaps between the conducting protrusion 43 and the insulative resin 11 even if gaps are formed between the terminal 4 and the flange 32 and/or between the terminal 4 and the casing 31.

Thus, for example, even if moisture moves from the exposed contact 46 of the conducting terminal 4 to the connecting part 42, the moisture is unlikely to reach the connector pin 41A because the insulative resin 11 is in close contact with the overall periphery of the conducting protrusion 43.

As such, a seal coating material or another sealing material is not necessary in the ignition coil 1. Moisture is unlikely to reach the connector pin 41A, and yet, the ignition coil 1 has a relatively simple structure in which the overall periphery of the conducting protrusion 43 is embedded in the insulative resin 11.

Due to the relatively simple structure of the ignition coil 1, moisture is unlikely to reach the connector pin 41A. This reduces the likelihood of short circuits (i.e., insulation failures) and/or contact failures (i.e., conduction failures) at the head 3 of the ignition coil 1. Furthermore, electric leaks are unlikely to occur at the primary voltage for supplying current to the primary coil 21. Thus, the ignition coil 1 is less likely to malfunction due to a signal waveform anomaly caused by noise on the signal control connector pins 41C.

Embodiment 2

Figure 14:
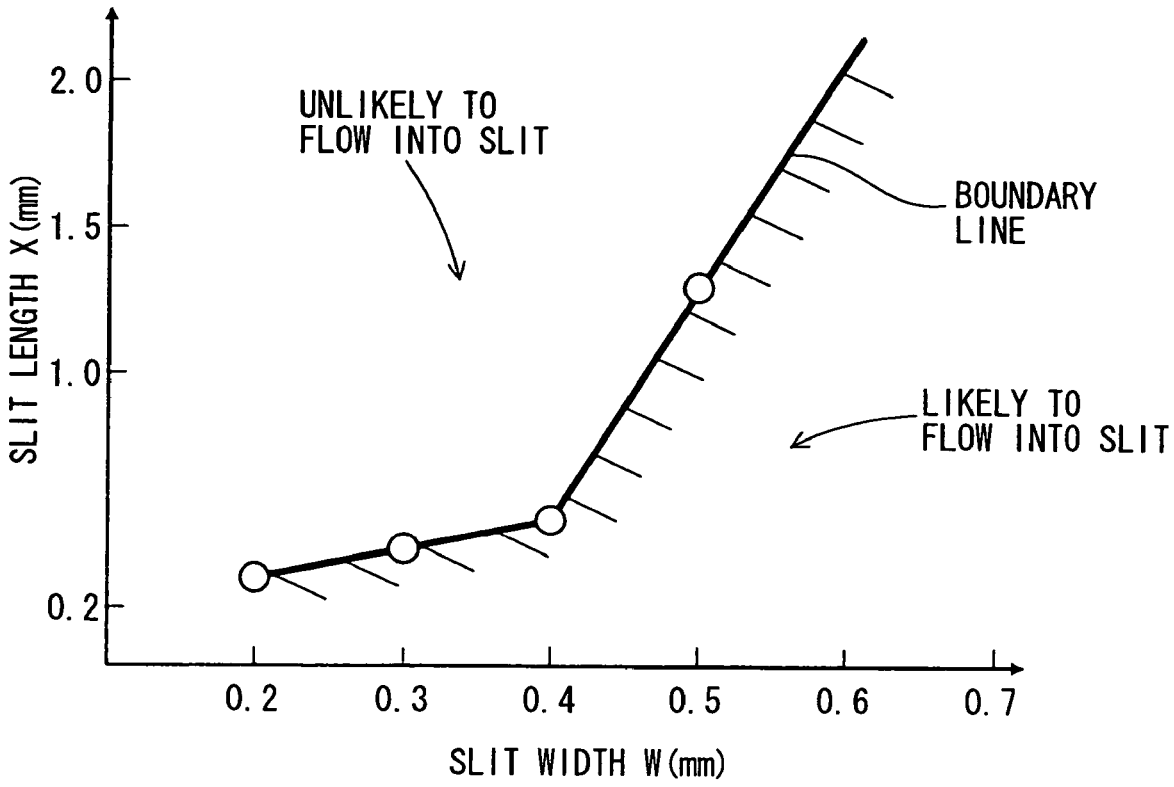
FIG. 14 is a graph showing the relationship between slit width and slit length according to another embodiment of the ignition coil.

In one embodiment, the width W and length X of the slit 44 are predetermined according to a function relating width W and length X, such as the function represented in FIG. 14. In other words, the width W and length X are selected such that the casing resin 311 is unlikely to flow into the slit 44 when the conducting terminal 4 is insert-molded in the casing resin 311.

FIG. 14 shows the slit width W and the slit length X along the horizontal and vertical axes, respectively, and a boundary line is included. An area to the left and above the boundary line represents widths W and lengths X at which the casing resin 311 is unlikely to flow into the slit 44, and an area to the right and below the boundary line represents widths W and lengths X at which the casing resin 311 is more likely to flow into the slit 44. Thus, the slit width W and length X are selected in a range above and to the left of the boundary line.

In one embodiment, the function is generated by experiment. For instance, slit width W is kept constant, and slit length X is gradually shortened until the casing resin 311 is unable to flow into the slit 44 to generate a data point of the boundary line. Another slit width W is selected, and slit length X is gradually shortened until the casing resin 311 is unable to flow into the slit 44 to generate another data point of the boundary line. In this embodiment, the experiments are run with a conducting protrusion 43 that is 0.64 mm in thickness.

In the embodiment of FIG. 14, the casing resin 311 flows more easily into the slit 44 if the slit width W is greater. As also seen from FIG. 14, the casing resin 311 flows more easily into the slit 44 if the slit length X is shorter. It is also seen that slope of the boundary line at slit widths W between 0.2-0.4 mm differs greatly from the slope of the boundary line at slit widths W between 0.4-0.6 mm.

It will be appreciated that the boundary line may change if the thickness T of the conducting protrusion 43, the molding pressure, the molding temperature, the material for the casing resin 311, and/or other conditions are changed. Accordingly, the slit width W and slit length X can also be selected depending on those conditions.

Embodiment 3

Figure 15:
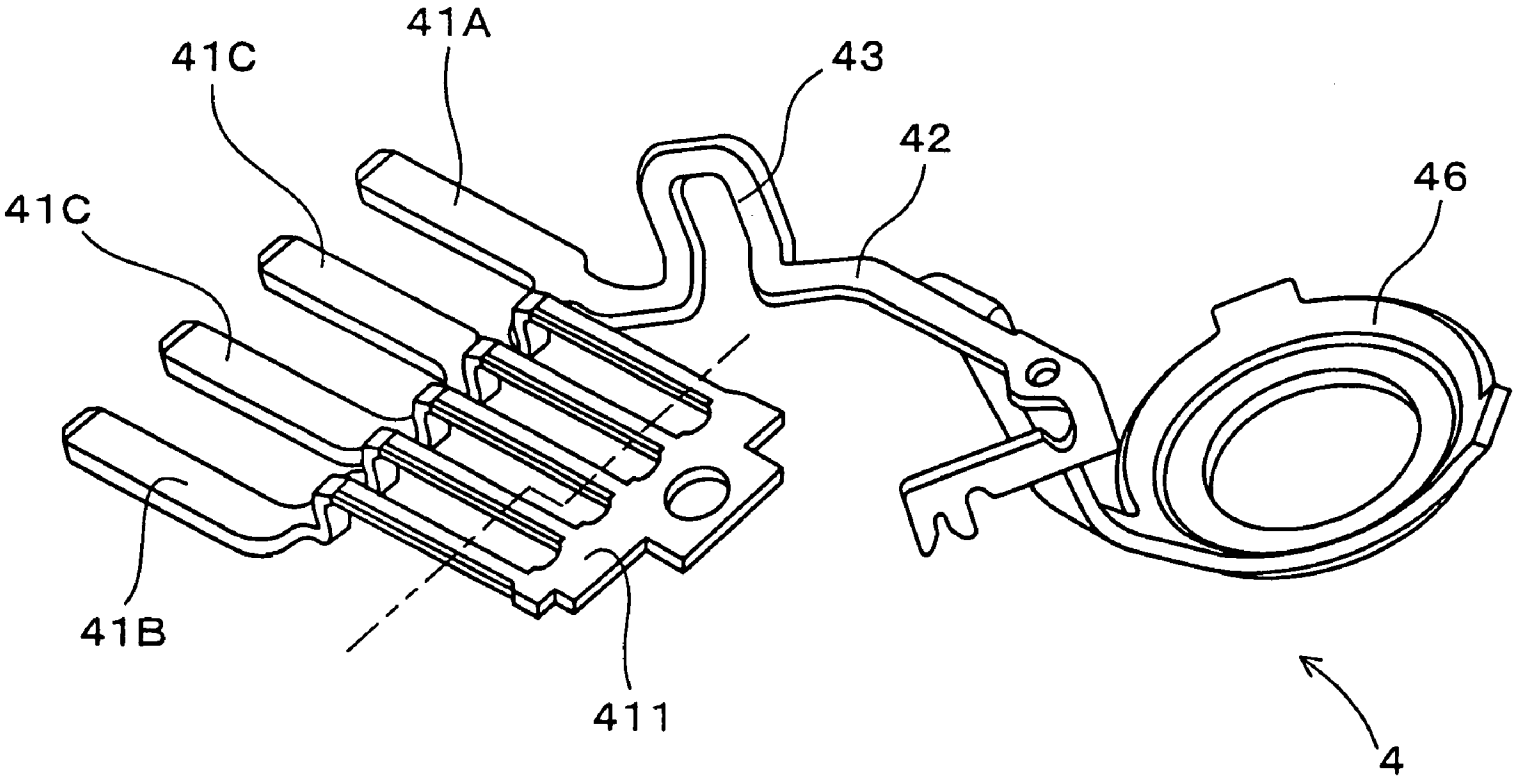
FIG. 15 is a perspective view of the conducting terminal of another embodiment of the ignition coil.
Figure 16:
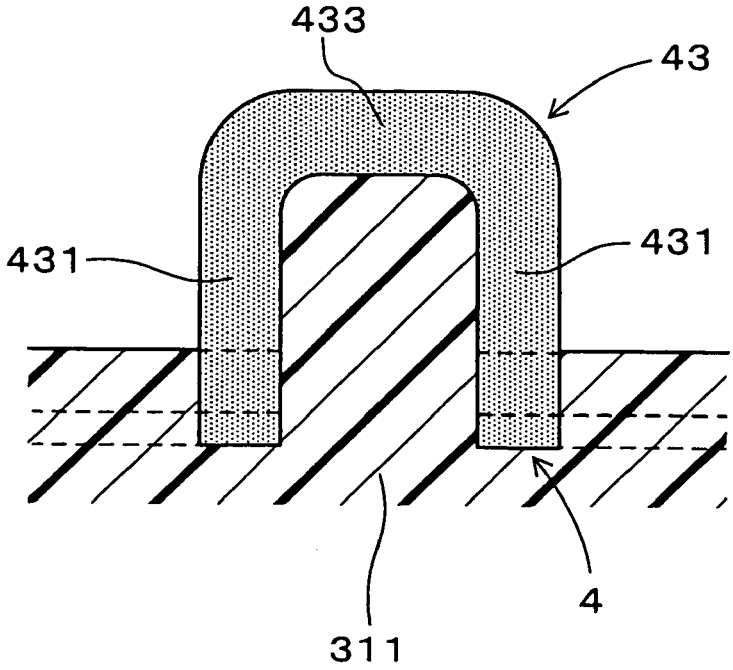
FIG. 16 is a sectional view of the conducting protrusion of the conducting terminal of the ignition coil according to the embodiment of FIG. 15, showing the terminal insert-molded in casing resin.

FIG. 15 shows the conducting terminal 4 used in this embodiment. As shown in FIG. 16, when the conducting terminal 4 is insert-molded in the casing resin 311, the casing resin 311 flows between the extending parts 431 and the link 433.

Figure 17:
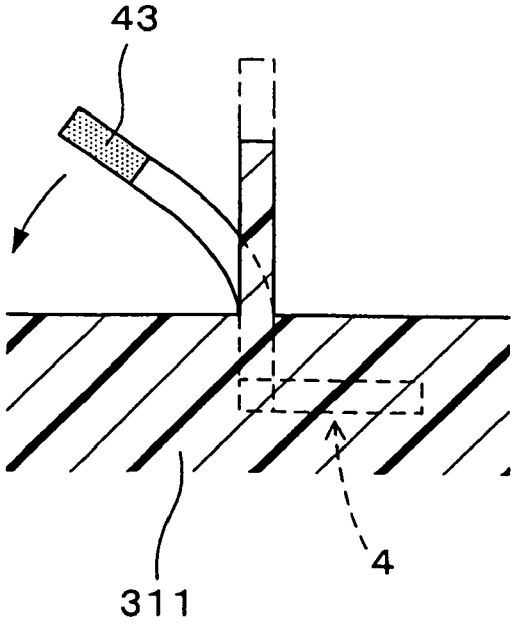
FIG. 17 is a sectional view of the conducting protrusion of the ignition coil according to the embodiment of FIG. 15, showing a bent protrusion.

Subsequently, as shown in FIG. 17, when the mold 7 is moved so that the cavity 72 is opened, or after the molded casing 31 is taken out of the mold 7, the conducting protrusion 43 is bent in a direction transverse to the axes of the extending parts 431. As such, the conducting protrusion 43 is spaced from the casing resin 311 that was previously included inside of the protrusion 43.

Figure 18:
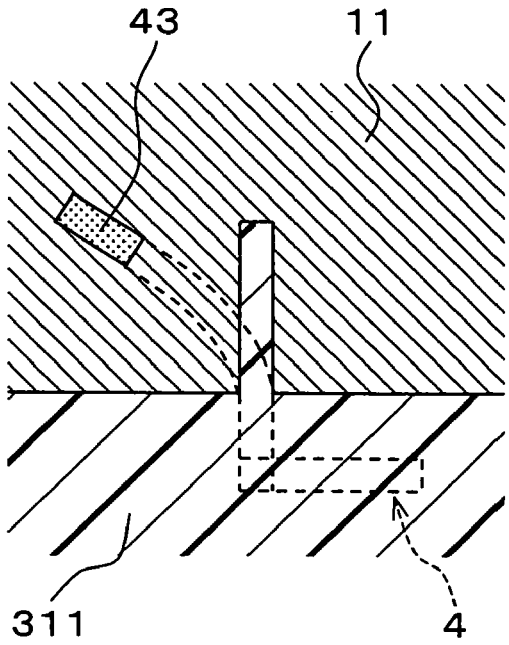
FIG. 18 is a sectional view of the conducting protrusion and adjoining parts of the ignition coil according to the embodiment of FIG. 15, showing the protrusion embedded in insulative resin.

Thereafter, as shown in FIG. 18, when insulative resin 11 is filled into the casing 31, it is also included in the conducting protrusion 43 between the extending parts 431 and the link 433 such that the conducting protrusion 43 is embedded in the insulative resin 11.

Embodiment 4

Figure 19:
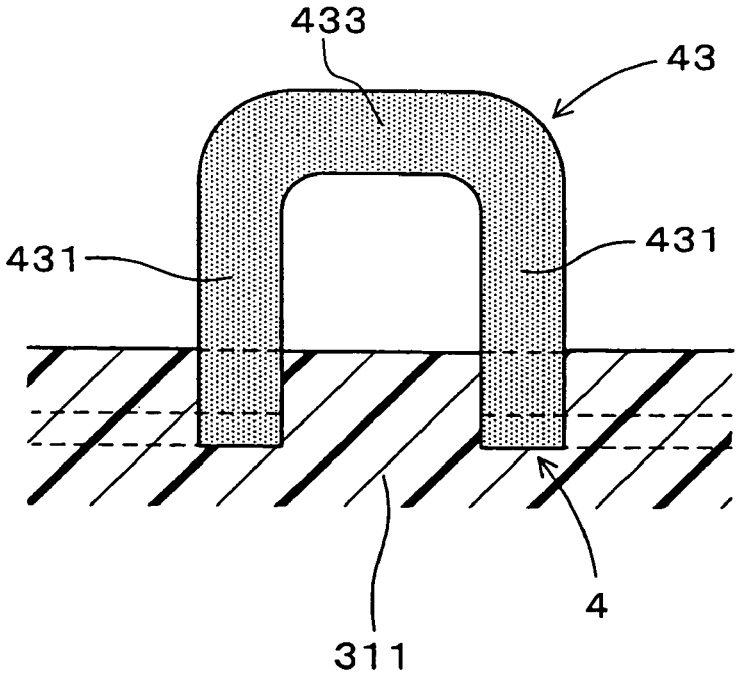
FIG. 19 is a sectional view of another embodiment of the conducting protrusion of the conducting terminal of the ignition coil, showing a removal of the casing resin.
Figure 20:
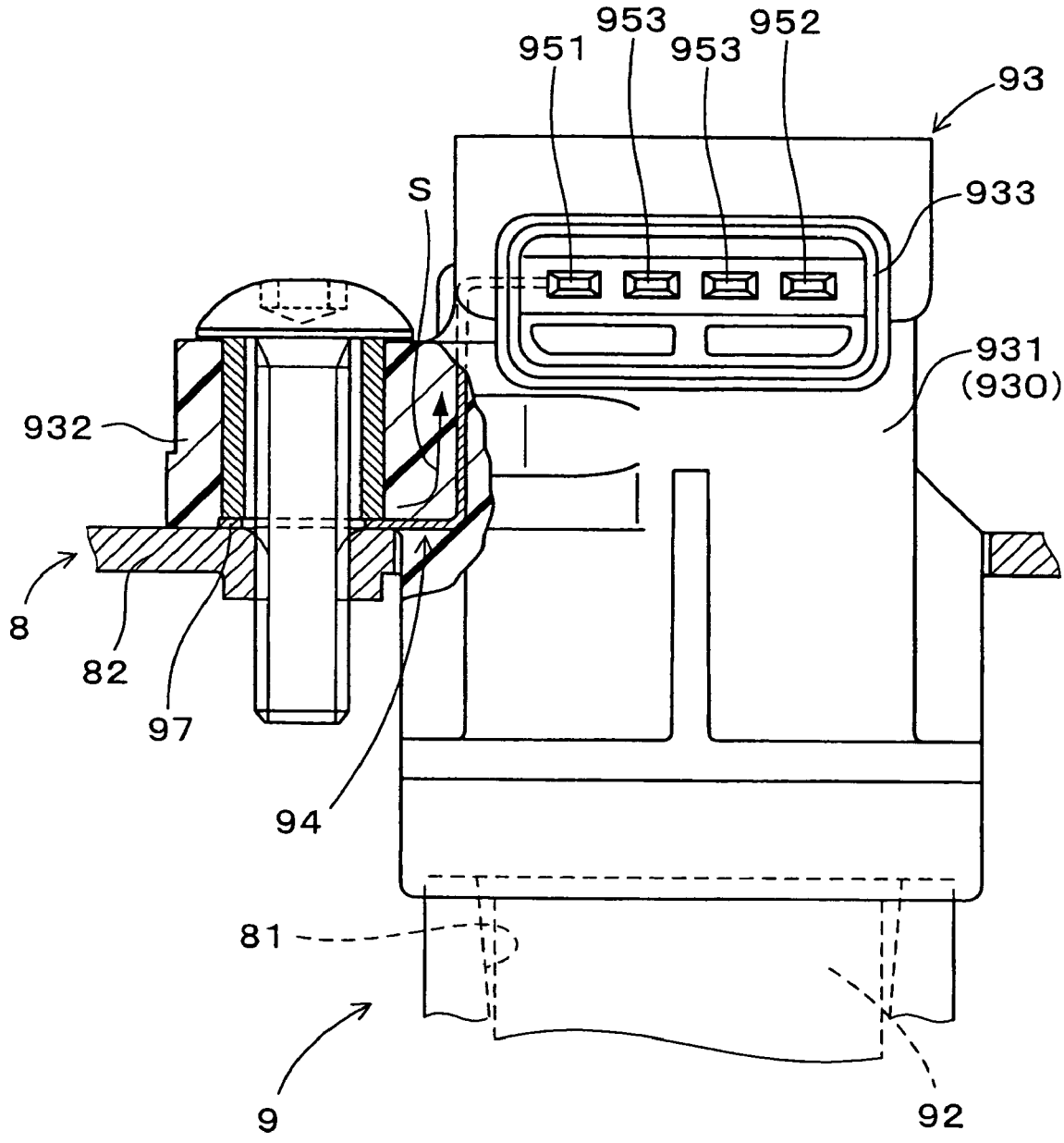
FIG. 20 PRIOR ART
FIG. 20 is an enlarged, partially sectional side view of the head of a conventional ignition coil.
Figure 21:
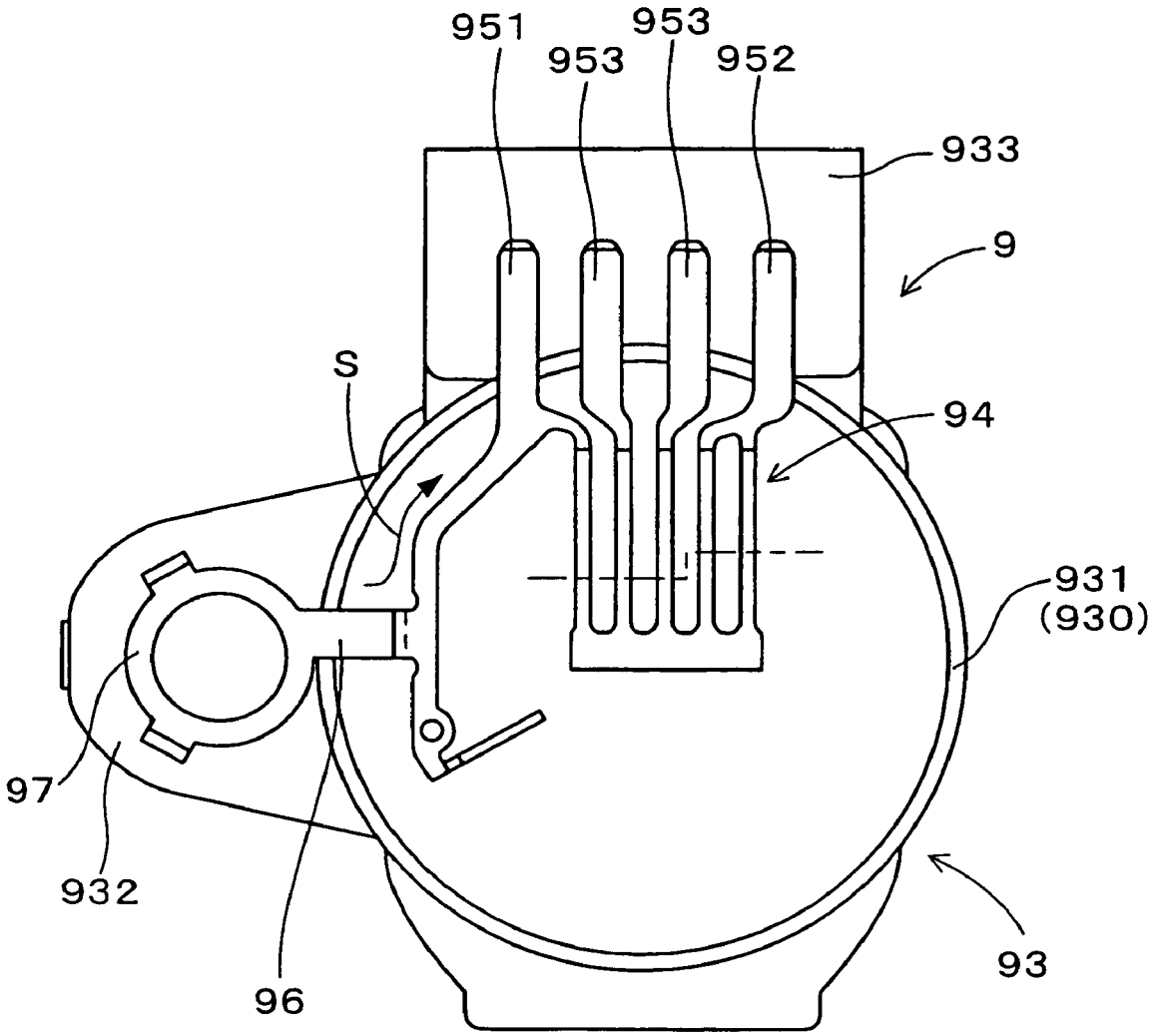
FIG. 21 PRIOR ART
FIG. 21 is a plan view of the conventional ignition coil of FIG. 20.

In this embodiment, when the conducting terminal 4 is insert-molded in the casing resin 311, the casing resin 311 flows between the extending parts 431 and the link 433 as shown in FIG. 16. Subsequently, as shown in FIG. 19, when the mold 7 is moved so that the cavity 72 is opened, or after the molded casing 31 is taken out of the mold 7, the casing resin 311 included inside the conducting protrusion 43. Thus, the overall periphery in section of the protrusion 43 is separated from the resin 311. Thereafter, when insulative resin 11 is introduced into the casing 31, the insulative resin 11 is also introduced in the conducting protrusion 43 between the extending parts 431 and the link 433. Accordingly, the conductive protrusion 43 is embedded in the insulative resin 11.

The present invention has been described in an illustrative manner. It is to be understood that the terminology, which has been used, is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. An ignition coil comprising:

a cylindrical body that has a primary coil and a secondary coil, which are coaxially wound relative to each other; and a head that extends from the cylindrical body and is fixed to an engine case, wherein:

spaces inside the head and the cylindrical body are filled by insulative resin;

the head includes:

a casing;

a flange that protrudes radially outward of the casing and is fixed to the engine case;

a connector that protrudes radially outward of the casing and is connected electrically to an external device of the ignition coil; and a conducting terminal that constitutes a conducting path; the conducting terminal includes:

a connector pin that is fitted at the connector;

an exposed contact that is exposed on a surface of the casing or the flange; and a connecting part that connects between the exposed contact and the connector pin;

the conducting terminal is insert-molded in a casing resin that constitutes the casing;

a portion of the conducting path of the connecting part is embedded in the insulative resin such that the insulative resin surrounds an entire outer perimeter of a cross section of the portion of the conducting path; and a remaining portion of the conducting path of the connecting part is embedded in the casing resin.

2. The ignition coil of claim 1, wherein:

the conducting terminal is a ground terminal that is connected electrically to the engine case;

the connector pin is a connector pin for ground potential; and the exposed contact is fitted on one end face of the flange so as to be in contact with the engine case.

3. The ignition coil of claim 1, wherein:

the connecting part includes a conducting protrusion as a portion of the conducting path thereof, the portion protruding from the casing resin; and an overall cross-sectional periphery of the conducting protrusion is embedded in the insulative resin.

4. The ignition coil of claim 3, wherein:

the conducting protrusion includes a pair of extending parts, which protrude from the casing resin to be connected with each other in the insulative resin.

5. The ignition coil of claim 4, wherein:

the conducting protrusion includes slit-forming protrusions, each of which inwardly protrudes from a corresponding one of the pair of the extending parts such that a slit is defined between the slit-forming protrusions, the slit being smaller than a space between the extending parts; and the insulative resin is filled in a part of the space between the extending parts, the part being located on an end side of the conducting protrusion in an protruding direction relative to formation positions of the slit-forming protrusions.

6. The ignition coil of claim 4, wherein:

the conducting protrusion includes a slit-forming protrusion, which protrudes from one of the extending parts toward the other one of the extending parts such that a slit is defined between the slit-forming protrusion and the other one of the extending parts, the slit being smaller than a space between the extending parts; and the insulative resin is filled in a part of the space between the extending parts, the part being located on an end side of the conducting protrusion in an protruding direction relative to a formation position of the slit-forming protrusion.

7. A method for manufacturing an ignition coil, which includes a cylindrical body and a head, wherein the cylindrical body has a primary coil and a secondary coil, which are coaxially wound relative to each other, the head extends from the cylindrical body and is fixed to an engine case, and spaces inside the head and the cylindrical body are filled by insulative resin, wherein:

the head includes a casing, a flange that protrudes radially outward of the casing and is fixed to the engine case, a connector that protrudes radially outward of the casing and is connected electrically to an external device of the ignition coil, and a conducting terminal that constitutes a conducting path; and the conducting terminal includes a connector pin that is fitted at the connector, an exposed contact that is exposed on a surface of the casing or the flange, and a connecting part that connects between the exposed contact and the connector pin, the method comprising:

insert-molding the conducting terminal in a casing resin of the casing such that the head, which includes the casing, is formed, and a conducting protrusion, which is a part of the conducting path of the connecting part, protrudes from the casing resin;

subsequently assembling the ignition coil; and introducing the insulative resin into the casing after the assembling of the ignition coil whereby the conducting protrusion is embedded in the insulative resin such that the insulative resin surrounds an entire outer perimeter of a cross section of the conducting protrusion.

8. The method of claim 7, wherein:

the conducting terminal is a ground terminal that is connected electrically to the engine case;

the connector pin is a connector pin for ground potential; and the exposed contact is fitted on one end face of the flange so as to be in contact with the engine case.

9. The method of claim 7, wherein:

the conducting protrusion includes a pair of extending parts, which protrude from the casing resin to be connected with each other, and slit-forming protrusions, each of which inwardly protrudes from a corresponding one of the pair of the extending parts such that a slit is defined between the slit-forming protrusions, the slit being smaller than a space between the extending parts;

a space for the insulative resin, which is to be filled with the insulative resin, is defined at a part of the space between the extending parts, the part being located on an end side of the conducting protrusion in an protruding direction relative to formation positions of the slit-forming protrusions;

at the time of the insert-molding of the conducting terminal in the casing resin, the defined slit does not permit the casing resin to be introduced into the slit and the space for the insulative resin; and at the time of the introducing of the insulative resin in the casing, the insulative resin is introduced into the space for the insulative resin.

10. The method of claim 7, wherein:

the conducting protrusion includes a pair of extending parts, which protrude from the casing resin to be connected with each other, and a slit-forming protrusion, which protrudes from one of the extending parts toward the other one of the extending parts such that a slit is defined between the slit-forming protrusion and the other one of the extending parts, the slit being smaller than a space between the extending parts;

a space for the insulative resin, which is to be filled with the insulative resin, is defined at a part of the space between the extending parts, the part being located on an end side of the conducting protrusion in an protruding direction relative to a formation position of the slit-forming protrusion;

at the time of the insert-molding of the conducting terminal in the casing resin, the defined slit does not permit the casing resin to be introduced into the slit and the space for the insulative resin; and at the time of the introducing of the insulative resin into the casing, the insulative resin is introduced into the space for the insulative resin.

11. The method of claim 7, further comprising:

bending the conducting protrusion to separate the overall cross-sectional periphery of the conducting protrusion from the casing resin after the insert-molding of the conducting terminal in the casing resin, wherein:

the introducing of the insulative resin into the casing is performed after the bending of the conducting protrusion.

12. The method of claim 7, further comprising:

removing the casing resin provided inward of the conducting protrusion after the insert-molding of the conducting terminal in the casing resin, wherein:

the introducing of the insulative resin into the casing is performed after the removing of the casing resin.

* * * * *